US008074703B2

(12) United States Patent
Poloni et al.

(10) Patent No.: US 8,074,703 B2
(45) **Date of Patent: *Dec. 13, 2011**

(54) OSCILLATING TABLE

(75) Inventors: Alfredo Poloni, Fogliano Redipuglia (IT); Andrea De Luca, Remanzacco (IT); Marco Ansoldi, Udine (IT)

(73) Assignee: Danieli & C. Officine Meccaniche S.p.A. (IT)

( * ) Notice: Subject to any disclaimer, the term of this patent is extended or adjusted under 35 U.S.C. 154(b) by 375 days.

This patent is subject to a terminal disclaimer.

(21) Appl. No.: 12/224,161

(22) PCT Filed: Feb. 23, 2007

(86) PCT No.: PCT/EP2007/051759

§ 371 (c)(1),
(2), (4) Date: Aug. 19, 2008

(87) PCT Pub. No.: WO2007/096421

PCT Pub. Date: Aug. 30, 2007

(65) Prior Publication Data

US 2009/0050287 A1 Feb. 26, 2009

(30) Foreign Application Priority Data

Feb. 24, 2006 (IT) ..... MI2006A0333

(51) Int. Cl.
*B22D 11/053* (2006.01)
*B22D 11/055* (2006.01)

(52) U.S. Cl. ..... 164/416; 164/443; 164/478

(58) Field of Classification Search ..... 164/478, 164/416, 443, 485

See application file for complete search history.

(56) References Cited

U.S. PATENT DOCUMENTS

| | | | |
|---|---|---|---|
| 5,623,983 | A | 4/1997 | Thone et al. |
| 5,642,769 | A | 7/1997 | Thone et al. |

FOREIGN PATENT DOCUMENTS

| | | | |
|---|---|---|---|
| DE | 100 24 514 | A1 | 11/2005 |
| GB | 2 156 252 | A | 10/1985 |
| WO | WO 98/53935 | | 12/1998 |
| WO | WO 99/12676 | | 3/1999 |

*Primary Examiner* — Kuang Lin

(74) *Attorney, Agent, or Firm* — Stetina Brunda Garred & Brucker

(57) ABSTRACT

Oscillating table for blooms or billets production plants, comprising pairs of bars, lying on at least one horizontal plane, which constitute the elastic support elements of the mold, thus permitting an optimal guidance of the oscillation thereof exclusively in the casting direction, said pairs of bars constituting a tie rod-strut system working in bending that confers to the table very high torsional and lateral stiffness. It allows a high precision in guiding mold thus consenting it wide oscillations in the axial casting direction only.

12 Claims, 6 Drawing Sheets

OSCILLATING TABLE

CROSS-REFERENCE TO RELATED APPLICATIONS

Not Applicable

STATEMENT RE: FEDERALLY SPONSORED RESEARCH/DEVELOPMENT

Not Applicable

TECHNICAL FIELD

The present invention refers to an oscillating table, in particular a table used in plants for the production of billets and blooms in order to allow the oscillation of a continuous casting mold.

STATE OF THE ART

Traditional oscillating tables have been described in various patent documents. Of these, document U.S. Pat. No. 5,642,769 describes a continuous casting device comprising a mold oscillation and guiding mechanism, mounted on a support structure. In particular, the oscillating table described comprises:

- a support structure fastened to the ground or floor of the factory,
- an intermediate support structure between said first structure and a mold,
- and the mold itself.

The intermediate support structure is suited to oscillating following the action of hydraulic or mechanical actuation means, and it is connected with the fixed structure and with the mold by means of a first and a second elastic membrane respectively.

The mold guiding mechanism comprises this second membrane that, like the first one, is made like a spring with a ring-shaped disk shape. This ring-shaped disk is connected in the proximity of its inner edge with the mold and in proximity of its outer edge with the intermediate support structure, by means of mechanical fixing means.

This oscillating table however presents a series of disadvantages.

A first disadvantage is that of providing elastic membrane elements between the structure fixed to the ground and the mobile intermediate structure. The use of the membrane does not make it possible to obtain very wide axial oscillations, as the stroke of the membrane is limited by its yield point. This membrane must, in fact, absorb in the elastic field all the guiding forces and each point of the membrane on the inner hole is stressed not only in traction along the radial direction, but also in traction from the adjacent points along circumferential directions; excessive stresses lead to the reaching of the yield point and then to the breaking of the same membrane.

A second disadvantage is represented by the fact that membranes connections with the fixed structure and the mobile structure must be made by means of a considerable quantity of screws, pins or other mechanical clamping means, necessary to distribute the loads generated by the forces induced by the oscillations on such a limited thickness of the same membrane.

Another disadvantage of this oscillating table is that it makes the operation of replacing the mold inconvenient in the case, for example, that the format of product to be cast has to be changed. Furthermore, the oscillating table is structured so as to not envisage the possibility of housing curved molds.

Lastly, a further disadvantage is represented by the fact that the cooling water under pressure, in addition to exercising a considerable force on the lower membrane connecting the structure fixed to the ground to the mobile intermediate structure, limits the good operation of the mold as even the water itself is set in motion creating undesired inertiae and additional forces, thus negatively influencing the dynamics of the organs in movement.

In other state of the art oscillating tables, the presence of bearings, subject to wear, makes their use disadvantageous as they require frequent maintenance with considerable costs and greater time consumption. Furthermore, during the steel product casting process, undesired oscillating table movements are created due to the clearances of the bearings, the value of which is amplified at high oscillation frequencies.

An attempt to overcome some of these drawbacks was made with the table described in the document U.S. Pat. No. 5,623,983. However, this has the disadvantage of having a bulky structure and excessive total weight Higher activation forces are therefore required, i.e. a greater oscillation command. Furthermore, the duration of the springs is limited by the high alternated bending stresses that result due to the high inertia. Deviations and displacements of the mold from the desired guiding trajectory are still observed, and also the heat influences are even more perceptible. Lastly, the configuration of this table makes the mold replacement operation difficult.

The need is therefore felt to produce an innovative oscillating table that makes it possible to overcome the above inconveniences.

SUMMARY OF THE INVENTION

The primary aim of this invention is to make an oscillating table for billets or blooms production plant that has a high torsional and lateral stiffness and that allows a high mold guiding precision, thus allowing it wider oscillations exclusively in the casting direction.

A further aim is to make an oscillating table of considerable constructive simplicity with an absence of mechanical organs subject to wear, such as, for instance, bearings, rotating pins, joints, runners, etc., thus practically eliminating the need for maintenance and obtaining a substantial saving of time and money.

The present invention therefore aims to overcome the drawbacks described above by producing an oscillating table that, according to claim 1, comprises

- a mobile structure, inserted into a support structure fastened to the ground, the mobile structure comprising a continuous casting mold defining a casting direction and suited to being guided in an oscillation by first elastic means, arranged transverse to the casting direction,
- actuation means, suited to transmitting alternating impulses in a direction substantially vertical to the mold, in order to cause an oscillation motion thereof, characterised by the fact that said first elastic means comprise an even number of pairs of first elastic bars and an even number of pairs of second elastic bars, said pairs of first bars being arranged alternatively on two first planes parallel to one another and equidistant from said casting direction, and said pairs of second bars being arranged alternatively on two second planes parallel to one another and equidistant from the casting direction, said second planes being substantially perpendicular to said first planes in order to give the table a predetermined torsional and lateral stiffness around the casting direction and to allow the oscillation of the mold in the casting direction only.

The greater constructive simplicity is also obtained by means of a device for clamping the mold-holder device, known as "cartridge", to said oscillating table. Said mold-holder device, incorporating a mold, comprising at one end thereof a structure forming a manifold for the feeding and distribution of at least one cooling fluid of the mold, characterised by the fact of providing hydraulic means for clamping said mold-holder device to the mobile structure of the oscillating table.

Advantageously, the particular configuration of the mold centring and guiding elements, preferably pairs of elastic bars of a round or flattened shape, allows an optimal guiding of its oscillation exclusively in the casting direction, excluding any roll movements around axes perpendicular to the casting axis that could be generated by a torsion moment, thanks to the combined action of tie-rods and struts working in bending.

Furthermore, such bars make it possible to obtain high lateral stiffness of the entire mobile structure, including the mold-holder device.

The oscillating table of the invention, in addition to guaranteeing a very high torsional and lateral stiffness, also makes it possible to obtain the following advantages:

- a low inertia as the organs in movement and weight thereof are reduced to a minimum;
- a low overall weight that is equal to about only 1600 kg, excluding the electromagnetic stirrer which is fixed statically, and is therefore a substantially halved weight with respect to the mobile part of a traditional table;
- the possibility of operating with wider oscillations than those of tables with membranes, wherein the stroke of the membranes is limited by the yield point thereof;
- the possibility of oscillating in curve following an arc with a circumference corresponding to a predetermined radius, i.e. of housing curvilinear molds, thanks to the possibility of installing part of the guiding elements in a inclined way with respect to a horizontal plane with a common axis of rotation;
- the possibility of optionally installing the stirrer inside the structure, envisaged for example in the case of the production of special and quality steel products, protecting it at the same time from any possibility of damage, for example from a high heat load, from the leakage of liquid steel, etc. . . . ;
- the possibility of an extremely rapid replacement of the mold, when necessary due to wear or format changes, thanks to the hydraulic brackets clamping system placed at the summit of the table.

A further advantage is represented by the fact that the hydraulic movement cylinders are connected to the structure with interlocking leaf-springs and not with pins or other mechanical organs, for example bearings or joints, which would involve maintenance operations. The complete absence of rotating organs in the oscillating table thus makes it possible to eliminate all the undesired movements due to the clearances, the value of which would be amplified over time, given the high oscillation frequencies.

The oscillating table of the invention provides the housing of a straight or curved a continuous casting mold, provided with longitudinal cooling holes made in the thickness, which permits minor deformations of the walls thereof, caused by the pressure of the cooling fluid that flows inside the holes, and therefore a greater overall stiffness. Advantageously, the feeding manifold of said fluid, being part of the mold-holder device, is fixed to the table by means of said hydraulic brackets: the presence of fixing screws and bolts is therefore reduced to a minimum, if not eliminated, and the replacement time is reduced to a minimum. Therefore, with respect to the solutions of the known art, the cooling water advantageously does not negatively influence the dynamics of the organs in movement.

The dependent claims describe preferred embodiments of the invention.

BRIEF DESCRIPTION OF THE FIGURES

Further characteristics and advantages of the invention will be further evident in view of the detailed description of a preferred, though not exclusive, embodiment of an oscillating table, such as illustrated by way of a non limiting example with the aid of the appended drawings wherein:

FIG. 5 *b* illustrates a variant of the second embodiment of the component in FIG. 4.

DETAILED DESCRIPTION OF PREFERRED EMBODIMENTS OF THE INVENTION

Figure 1:
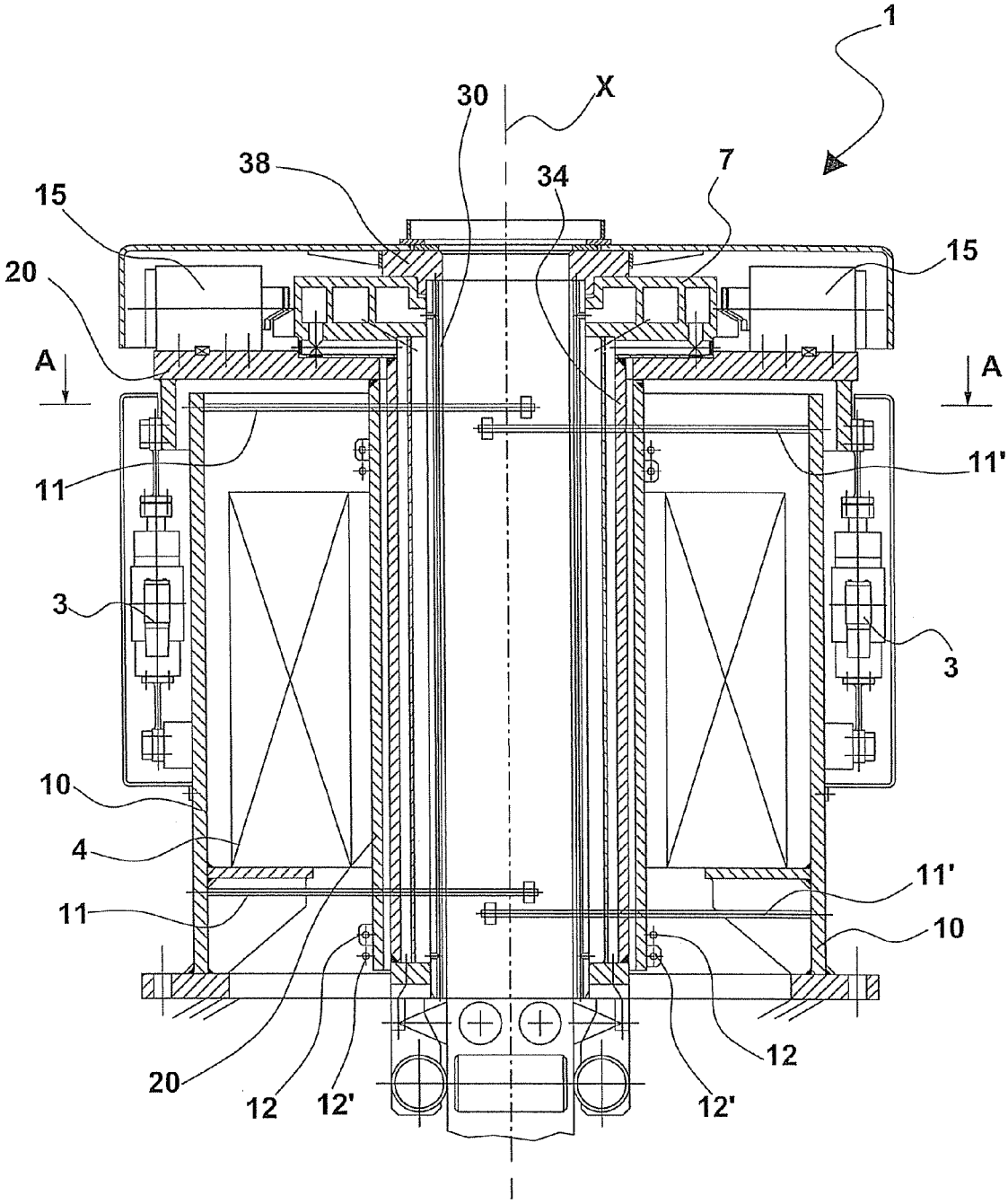
FIG. 1 illustrates a vertical section of the oscillating table according to the invention.

FIG. 1 illustrates an oscillating table, globally indicated with the reference 1, which presents an external load-bearing structure 10 or first support structure, fixed to the ground. A second intermediate support structure 20, suited to housing a tubular a continuous casting mold 30 contained in a mold-holder device or cartridge 34 provided with a manifold 7 for feeding and distributing at least one cooling fluid of the mold, cooperates with the external load-bearing structure 10. Continuous Casting Mold 30 and manifold 7 are solidarity joined by an upper closing flange 38.

The oscillation movement at the second structure 20 and, therefore, at the mold-holder device 34 containing the mold 30 is given by an oscillation control, comprising for example a pair of hydraulic actuation means 3, such as cylinders. These hydraulic actuation means 3 are connected to the ground with interlocking leaf-springs and are connected at the other end thereof to the second structure 20, as a mobile element, again with an interlocking leaf-spring. As in such an oscillation control there is a complete absence of bearings, pins, joints or other mechanical organs, one eliminates the clearances of such components, which are notoriously subject to wear, entailing frequent maintenance operations. In order to avoid deviations of the mold 30 from the desired trajectory, preferably that one along the casting direction or axis X defined by the mold 30, there are provided elastic guiding elements 11, 11', 12, 12' of the second structure 20 housing in the central cavity thereof the mold-holder device 34, closely fastened thereto through hydraulic brackets 15 or other mechanical means.

Figure 2:
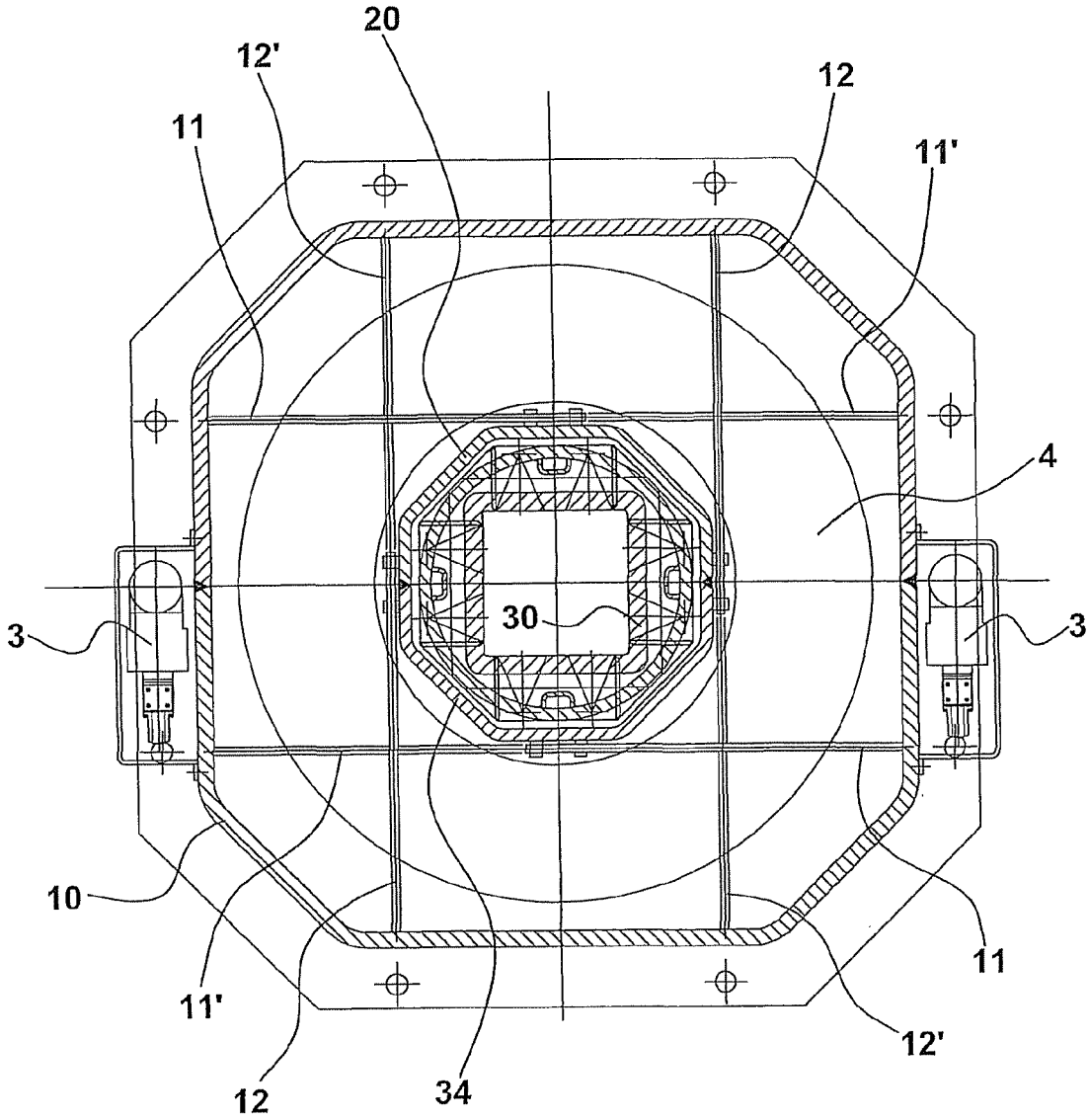
FIG. 2 illustrates a section along the A-A plane of the plane view of the oscillating table of FIG. 1.

Such guiding elements 11, 11', 12, 12', for example in the form of interlocking round or flattened elastic bars, are arranged as illustrated, for example, in FIGS. 1 and 2.

In this preferred embodiment, such elastic guiding elements advantageously comprise four pairs of first elastic bars 11, 11' and four pairs of second elastic bars 12, 12'. The number of pairs of the first and second bars may also be different but is, in any case, an even number.

The four pairs of the first elastic bars 11, 11' are arranged in pairs respectively on two first vertical planes parallel to one another and to the casting axis X and equidistant from said axis. Similarly, the four pairs of the second elastic bars 12, 12' are arranged in pairs respectively on two second vertical planes parallel to one another and to the casting axis X and equidistant from said axis; said second planes being substantially perpendicular to said first planes.

The bars 11, 11', 12, 12', such as for example round bars or bars of other substantially flattened shape sections, such as for example rectangular, at a first end thereof are fixed to the second support structure 20 of the mold-holder device 34, i.e. to the mobile part of the oscillating table, and at a second end thereof they are fixed to the outer load-bearing structure 10 or first support structure.

The systems for fixing the bars to the support structure 20 are constituted, for example, by brackets welded to said structure that present passing holes in which the bars are inserted; the ends of such bars are threaded and their locking on the brackets takes place by means of nuts.

The fixing of the bars to the outer load-bearing structure 10 can be performed with similar systems, i.e. by means of introduction of the threaded end of the bars into the thickness of the structure and locking thereof with nuts.

On each of these first and second vertical planes, the distance between the upper pair of bars, arranged in proximity of the mold head, and the lower pair, arranged in the proximity of the mold feet, is advantageously the same. The first elastic bars 11, 11' are parallel to one another, as are the second elastic bars 12, 12'.

The elastic bars are arranged so as to be stiff to bending in the transverse directions with respect to the casting direction X or the oscillating direction and flexible in direction X only.

One embodiment provides the use of leaf-springs or similar springs as elastic guiding elements of the mold 30.

Advantageously, the fact that on each of said first and second vertical planes each of the elastic bars of each pair presents the first end fixed to the mobile part of the table and the second end fixed to the fixed part in the opposite way with respect to the corresponding ends of the immediately adjacent bar of the same pair, together with the fact that the arrangement of the pairs of the corresponding bars respectively on the first and second planes is asymmetrical with respect to the casting direction or axis X (as shown for example by observing the bars 12, 12' in FIG. 1 or in FIG. 2), makes the oscillation of the mold 30 only possible along the direction of the casting axis X.

In fact, such configuration of the pairs of elastic bars 11, 11', 12, 12' makes it possible to contrast each torsion moment that could occur parallel to the casting direction X. According to the sense of this torsion moment, half of the bars will be subject to traction, acting as tie-rods, whereas the other half will be subject to compression, acting as struts.

Figure 3:
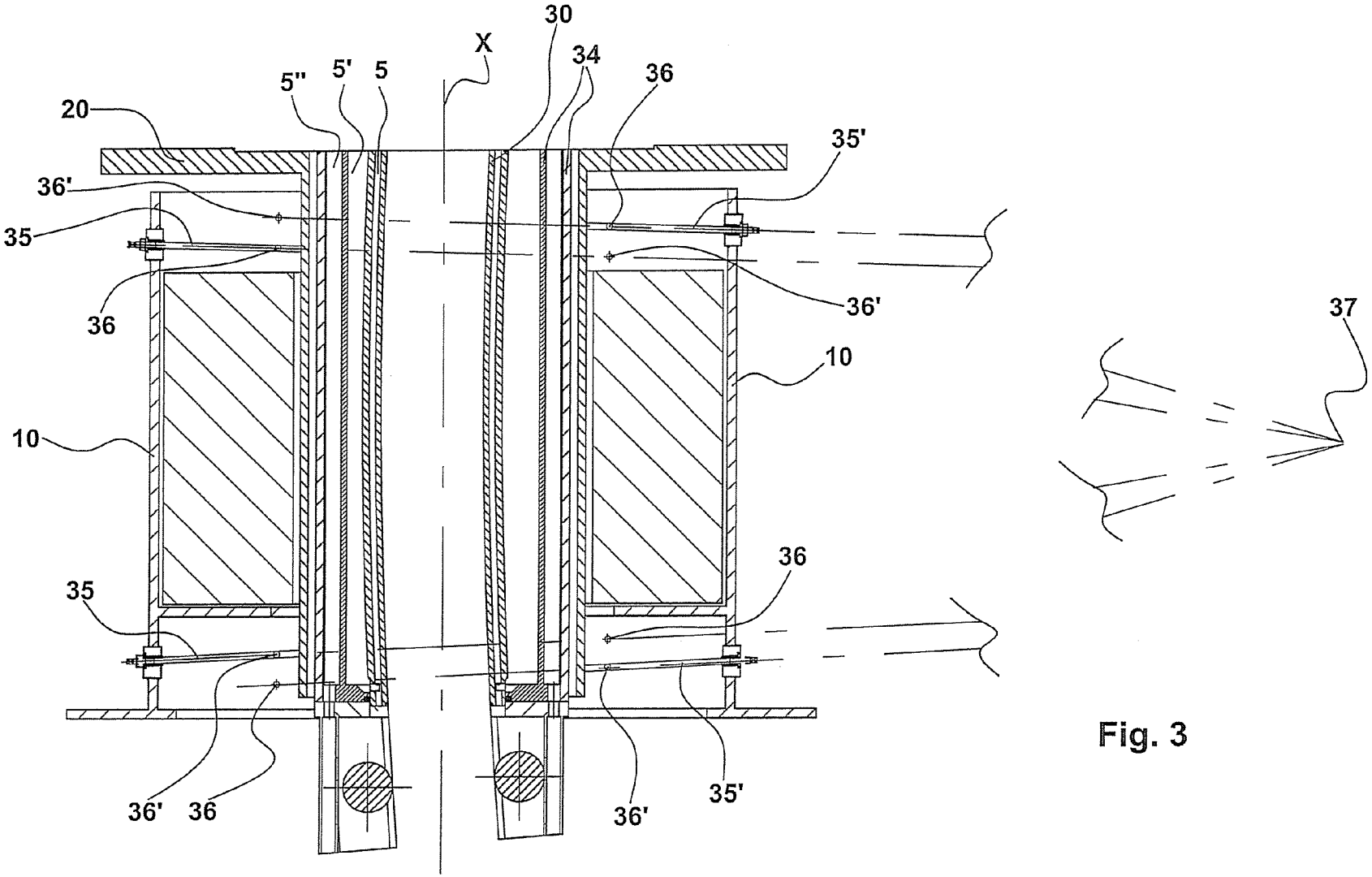
FIG. 3 illustrates a vertical section of a variant of the oscillating table according to the invention.
Figure 4:
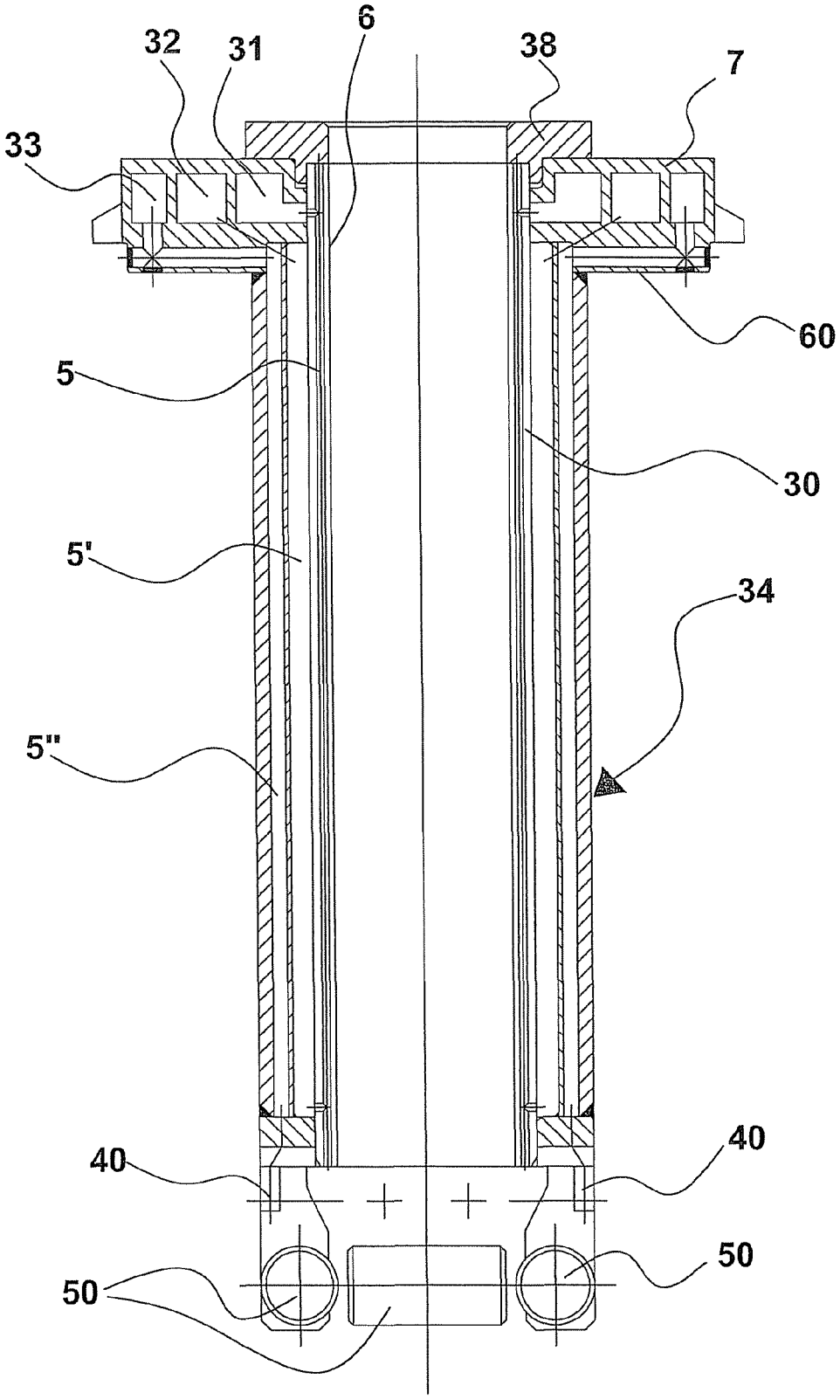
FIG. 4 illustrates a vertical section of a first embodiment of a component of the oscillating table of FIG. 1.

A second embodiment of the oscillating table, object of this invention, provides the housing of curved molds inside the second support structure 20. One example of this table is illustrated in FIG. 3. In this case, there are provided advantageously on the two first vertical planes two pairs of first elastic guiding elements 35, 35', for example in the form of interlocking elastic rounded or flattened elastic bars, each pair having a predetermined inclination, equal in absolute value but opposite sign to the other pair, with respect to a horizontal plane perpendicular to casting direction X. On each first vertical plane the two pairs of first elastic bars 35, 35' respectively have an ideal intersection point 37 that defines a common centre of rotation. The two centres of rotation are arranged on an axis of rotation lying on said horizontal plane and perpendicular to casting direction or axis X in order to allow the oscillating movement of the table by following a circumference arc corresponding to a predetermined radius of curvature.

In general, the pairs of the first elastic bars 35, 35' on each first vertical plane are not parallel to one another, they may present different inclinations to one another and their ideal intersection point defines an ideal common centre of rotation.

Similarly to the first embodiment, there are provided four pairs of the second elastic bars 36, 36' arranged in pairs respectively on two second vertical planes parallel to one another and to the casting axis X and equidistant from said axis; said second planes being substantially perpendicular to said first planes. The second elastic bars 36, 36', unlike the first bars 35, 35', are arranged horizontally and are all parallel to one another.

Also in this embodiment, the fact that on each of said first and second vertical planes each of the elastic bars of each pair presents the first end fixed to the mobile part of the table and the second end fixed to the fixed part in the opposite way with respect to the corresponding ends of the immediately adjacent bar of the same pair, together with the fact that the arrangement of the pairs of corresponding bars respectively on the first and second planes is asymmetrical with respect to the casting direction or axis X, makes the oscillation of the mold 30 only possible along the direction of the casting axis X, following a circumference arc corresponding to a predetermined radius of curvature, substantially equal to the radius of curvature of the curved mold or of a different value.

In both embodiments of the oscillating table of the invention, the use of considerably simplified elastic guiding elements and the particular configuration thereof thus allows a very high guiding precision of the mold and a considerable reduction in the oscillation marks on the cast product.

The oscillating table object of the invention also allows, thanks to the improvements described above, a greater compactness and constructive simplicity and an operation at oscillation frequencies of over 6 Hz, higher than the normal frequencies equal to 4 Hz.

Given the compactness and the lower weight of the mobile part of the invention table it is not necessary to provide further elastic means, for example compression or air or leaf-springs, with the function of lightening the weight of the structure thereof.

In the case of the production of cast products, for example, made of special steels and quality steels there is provided the use of an electromagnetic stirrer 4, arranged between the external load-bearing structure 10 and the intermediate support structure 20 and advantageously protected from the heat load. The overall weight of the oscillating table, without the stirrer 4, is approximately 1600 kg, approximately half that of a traditional oscillating table.

Further advantages of the oscillating table of the invention derive from the fact of being able to house with a simple operation the tubular mold 30, straight or curved, in the second support structure 20.

In fact, the mold-holder device 34 is fixed to the oscillating table 1, together with a ring-shaped manifold 7 for the feeding of the cooling fluids, obtained by melting or by means of a welded structure and that surrounds the mold head, thanks to the surface 60 that acts as a rest to the support structure 20 and by means of hydraulic brackets 15.

Said mold 30, which is preferably monolithic, is provided with longitudinal cooling holes 5 produced in the thickness: this makes it possible to obtain smaller wall deformations, thanks to the pressure of the cooling fluid that runs inside the holes 5, and therefore a greater stiffness. This greater stiffness also determines a better heat exchange between the walls of the mold and the liquid steel thus obtaining a lesser rhomboidity of the cast product and a better external superficial quality thereof; this type of mold construction is also able to maintain its taper over time.

The longitudinal cooling holes 5, said cooling known as primary, being close to the inner walls 6 of the mold, permit an excellent heat exchange and, therefore, the transfer of the heat of the liquid metal, inside of the mold, towards the outside. The longitudinal holes 5 are preferably arranged parallel to one another and to casting direction or axis X.

The primary cooling fluid, generally water, is introduced into the holes 5 from the top towards the bottom through a first feeding chamber 31 of the ring-shaped manifold 7, fed by hoses not shown. The feeding from the top towards the bottom allows a better heat exchange in the top part of the mold.

The inner wall of the mold-holder device 34 and the external wall of the mold 30 advantageously define a duct 5' for the re-ascent of the primary cooling fluid, said duct communicating with the holes or channels 5 in correspondence with the foot of the mold 30.

Advantageously, the ring-shaped manifold 7 also comprises the return circuit chamber 32 of the primary cooling fluid and a second feeding chamber 33 of the secondary cooling fluid, preferably untreated water, that goes to feed the sprays 40, arranged in correspondence with the rollers 50 at the foot of the mold 30, crossing a further duct or several ducts 5", made in the thickness of the mold-holder device 34, in order to cool the billet immediately upon exiting the mold. The same water cools said rollers at the foot also outside.

The presence of the three-chambered manifold 7 and the relative holes or ducts made in the thickness of the mold walls and of the mold-holder device allow a further compactness of the entire oscillating table and a reduction in weight of the intermediate support structure 20, and therefore a lower inertia of the mobile part of the table.

Preferably the chambers 31, 32, 33 are arranged inside the ring-shaped manifold 7 in a concentric way with respect to said casting direction. On a plane perpendicular to casting direction X the mold 30 may have for example, a circular or square or rectangular or other form.

Figure 5A:
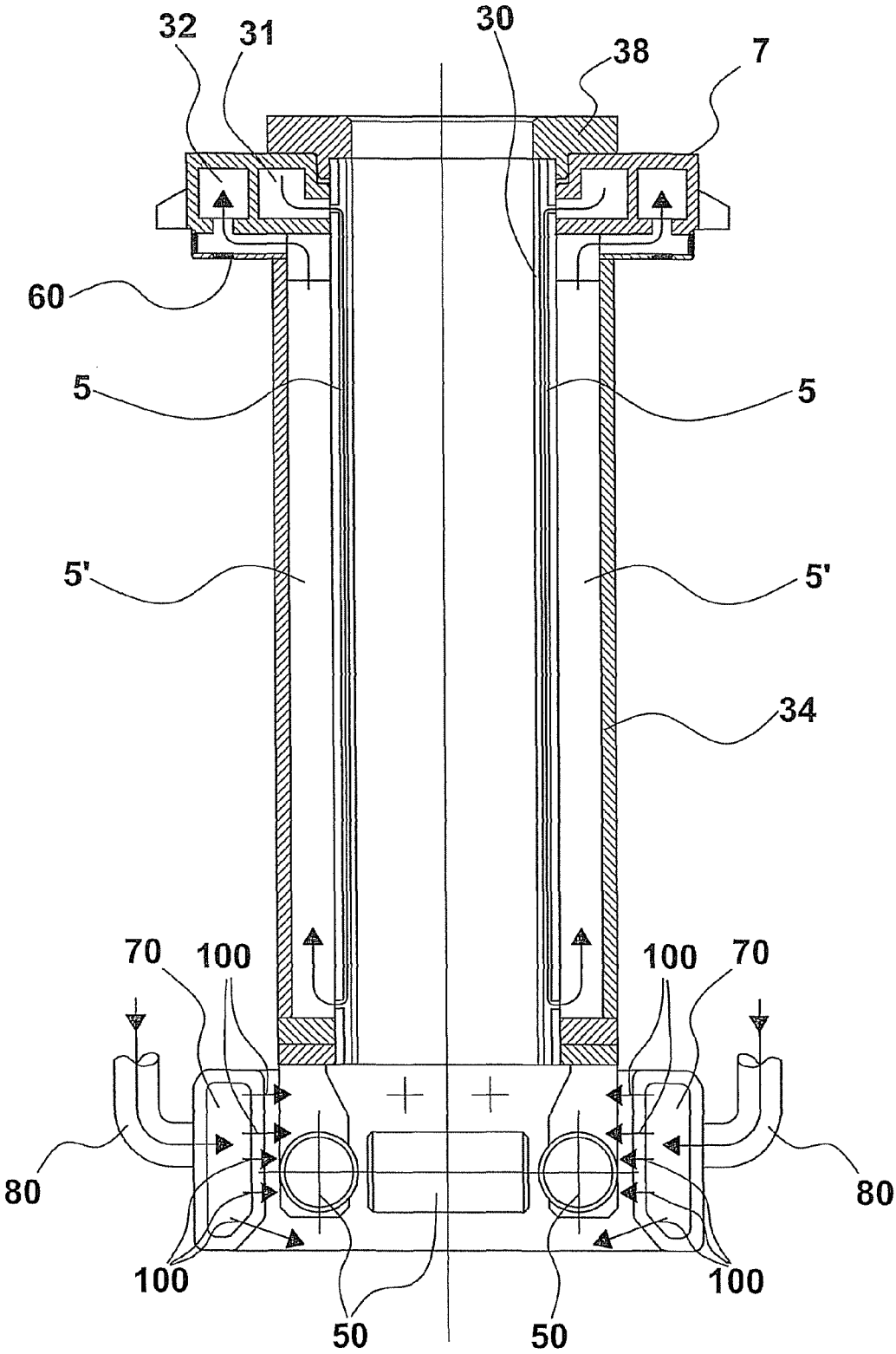
FIG. 5 *a* illustrates a vertical section of a second embodiment of a component of the oscillating table of FIG. 4.
Figure 5B:
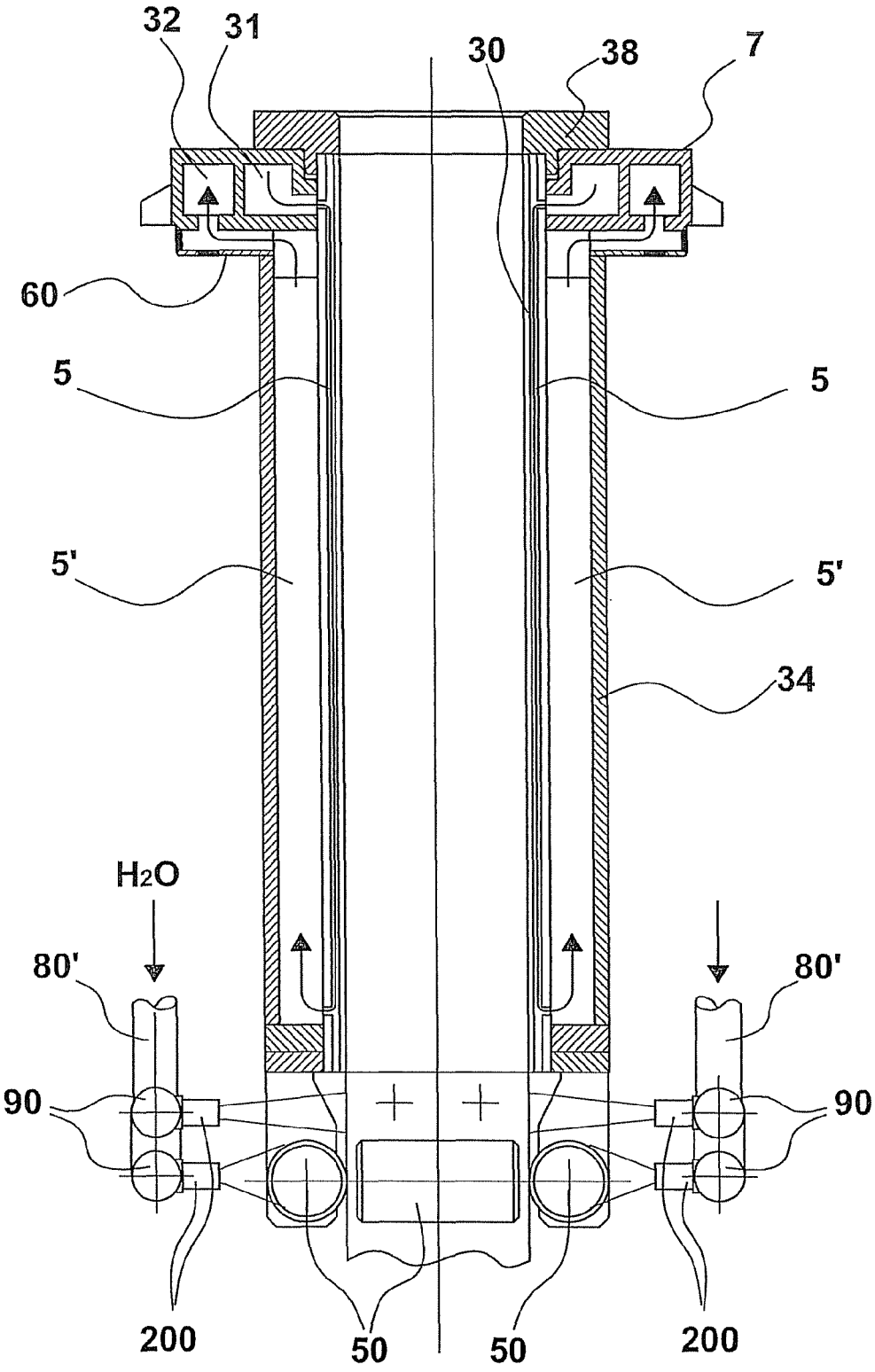

The oscillating table of the invention may advantageously house other embodiments of the mold-holder device 34, illustrated in FIGS. 5 *a* and 5 *b*.

The mold-holder device illustrated in FIG. 5 *a* is provided with a cooling fluid feeding manifold 7, preferably but not necessarily ring-shaped, comprising only the primary cooling fluid feeding chamber 31 and the return circuit chamber 32 of said fluid. In addition to the longitudinal holes or channels 5 made in the thickness of the mold 30, only one or more ducts 5' are provided in the cartridge 34 for the re-ascent of the primary cooling fluid. Also in this case, in fact, the longitudinal holes 5 are communicating with the duct 5' in correspondence with the foot of the mold 30.

Advantageously, the secondary cooling, i.e. the cooling with untreated water of the continuous ingot upon exiting the mold and the rollers 50 at the foot, is made by means of one or more external water feeding manifolds, arranged in correspondence with the lower end of the mold.

A first variant illustrated in FIG. 5 *a* provides an external manifold 70 fixed to the external support structure 10, fixed to the ground, of an oscillating table in which the mold-holder device is housed in this first embodiment, the external manifold is constituted by a ring-shaped chamber 70 fed with a pressurised cooling fluid, generally untreated water, by tubes 80. In the internal part thereof, said ring-shaped chamber 70 is provided with a plurality of holes 100 suited to generating jets of said fluid towards the rollers 50 at the foot and the continuous ingot.

One second variant, illustrated in FIG. 5 *b* on the other hand, provides tubes 80' that feed ring-shaped manifolds 90 that in turn feed spray nozzles 200, arranged in correspondence with the rollers 50 at die foot of the mold 30.

Advantageously, this second embodiment of the mold-holder device in its two variants makes it possible to obtain a greater compactness of the manifold 7, a reduction of the overall dimensions and a greater constructive simplicity of the mold-holder device, as fewer seals are needed, and a lower overall weight of the cartridge-mold complex.

This secondary cooling system, in both the variant with spray nozzles and in the perforated chamber variant, is fixed to the fixed support structure of the oscillating table and therefore it does not oscillate with the rest of the ingot mould, thus reducing the inertia of the mobile part made to oscillate by the table.

A further advantage is represented by the fact that such external secondary cooling system is not replaced together with the mold and can be used for all cast sections.

The invention claimed is:

1. Oscillating table comprising a mobile structure, inserted into a support structure fastened to the ground, the mobile structure comprising a continuous casting mold having a longitudinal axis X defining a casting direction and suited to being guided in an oscillation by first elastic means, arranged transverse to the longitudinal axis X, actuation means, suited to transmitting alternating impulses in a direction substantially vertical to the mold, in order to cause the oscillation motion thereof, characterised by the fact that said first elastic means comprise an even number of pairs of first elastic bars and an even number of pairs of second elastic bars, said pairs of first bars being arranged alternatively on two first planes parallel to one another and equidistant from said longitudinal axis X, and said pairs of second bars being arranged alternatively on two second planes parallel to one another and equidistant from the longitudinal axis X, said second planes being substantially perpendicular to said first planes in order to give the table a predetermined torsional and lateral stiffness around the longitudinal axis X and to allow the oscillation of the mold in the longitudinal axis X only.

2. Oscillating table according to claim 1, wherein each of the elastic bars of each pair provides a first end fixed to the mobile structure and a second end fixed to the support structure, in the opposite way to the corresponding ends of the other bar of the same pair.

3. Oscillating table according to claim 2, wherein the arrangement of the pairs of first and second bars respectively corresponding to the first and to the second planes is asymmetrical with respect to the longitudinal axis X.

4. Oscillating table according to claim 3, wherein there are provided second elastic means connecting the actuation means to the ground.

5. Oscillating table according to claim 4, wherein the mold is housed inside a mold-holder device fixed to the mobile structure by means of a fixing device comprising hydraulic brackets.

6. Oscillating table according to claim 5, wherein the even number of pairs of first and second elastic bars is equal to four.

7. Oscillating table according to claim 6, wherein the pairs of the first elastic bars are parallel to one another.

8. Oscillating table according to claim 6, wherein the pairs of the first elastic bars on each first vertical plane are not parallel to one another, and their ideal intersection point defines a common ideal centre of rotation.

9. Oscillating table according to 1 wherein said elastic bars have a round cross section.

10. Oscillating table according to claim 1, wherein said elastic bars have a flattened rectangular cross section.

11. Device for fixing a mold holder device to an oscillating table according to claim 1, said mold holder device incorporating a mold and comprising in correspondence with one end thereof a casing for the feeding of at least one mold cooling fluid, characterised by the fact of providing hydraulic fixing means for fixing said mold holder device to a mobile structure of the oscillating table.

12. Device according to claim 11, wherein said hydraulic fixing means are hydraulic brackets.

* * * * *